US009225150B2

(12) United States Patent
Nishida et al.

(10) Patent No.: US 9,225,150 B2
(45) Date of Patent: Dec. 29, 2015

(54) SPARK PLUG

(71) Applicant: NGK Spark Plug Co., LTD., Nagoya (JP)

(72) Inventors: Masahiro Nishida, Konan (JP); Tomoaki Kato, Nagoya (JP); Keiji Ozeki, Konan (JP); Naoyuki Mukouyama, Nisshin (JP); Tsutomu Kobayashi, Inazawa (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 14/412,118

(22) PCT Filed: Jul. 16, 2013

(86) PCT No.: PCT/JP2013/004344

§ 371 (c)(1),
(2) Date: Dec. 30, 2014

(87) PCT Pub. No.: WO2014/013723

PCT Pub. Date: Jan. 23, 2014

(65) Prior Publication Data

US 2015/0188294 A1 Jul. 2, 2015

(30) Foreign Application Priority Data

Jul. 17, 2012 (JP) ..... 2012-158280
Nov. 1, 2012 (JP) ..... 2012-241478
Jul. 15, 2013 (JP) ..... 2013-147158

(51) Int. Cl.
*F02M 57/06* (2006.01)
*F02P 13/00* (2006.01)

(Continued)

(52) U.S. Cl.
CPC . *H01T 13/36* (2013.01); *H01B 3/12* (2013.01)

(58) Field of Classification Search
CPC ..... H01T 13/00; H01T 13/02; H01T 13/12; H01T 13/20; H01T 13/34; H01T 13/36
USPC ..... 313/118, 143
See application file for complete search history.

(56) References Cited

U.S. PATENT DOCUMENTS 5,831,377 A * 11/1998 Matsubara et al. ..... 313/141
6,111,345 A * 8/2000 Shibata et al. ..... 313/141

(Continued)

FOREIGN PATENT DOCUMENTS

JP 3502936 B 3/2004
JP 2006-066385 A 3/2006

(Continued)

OTHER PUBLICATIONS

International Search Report mailed Aug. 13, 2013 for the corresponding PCT Application No. PCT/JP2013/004344.

*Primary Examiner* — Thomas A Hollweg
*Assistant Examiner* — Kevin Quarterman
(74) *Attorney, Agent, or Firm* — Leason Ellis LLP

(57) ABSTRACT

A spark plug includes an insulator including an axial hole and having an outer periphery with a tapered outer face; a metal shell having a thread portion and a tapered inner face; and a circular packing sandwiched between the tapered outer face of the insulator and the tapered inner face of the metal shell. On at least one cross section including the axis, (A/B)≥3.1, B≥0.25, and (A+B)≤2.0 are satisfied, where A represents a length of (a difference between an effective diameter of the thread portion and an inner diameter at a rear end of the tapered inner face)/2, and B represents a length of (a difference between the inner diameter at the rear end of the tapered inner face and an inner diameter at a front end of the tapered inner face)/2.

8 Claims, 3 Drawing Sheets

(51) Int. Cl.

| | |
|---|---|
| ***H01T 13/00*** | (2006.01) |
| ***H01T 13/36*** | (2006.01) |
| ***H01B 3/12*** | (2006.01) |

(56) References Cited

U.S. PATENT DOCUMENTS

| | | | | |
|---|---|---|---|---|
| 6,373,173 | B1 * | 4/2002 | Suzuki | 313/143 |
| 6,414,420 | B1 | 7/2002 | Suzuki | |
| 6,653,768 | B2 * | 11/2003 | Kato et al. | 313/143 |
| 7,443,089 | B2 * | 10/2008 | Hoffman et al. | 313/141 |
| 8,643,263 | B2 * | 2/2014 | Burrows | 313/143 |
| 2002/0041135 | A1 | 4/2002 | Fukushima et al. | |
| 2003/0168954 | A1 | 9/2003 | Suzuki | |
| 2006/0022566 | A1 | 2/2006 | Ishiguro | |
| 2006/0042610 | A1 * | 3/2006 | Abe et al. | 123/635 |
| 2007/0126330 | A1 * | 6/2007 | Kuki et al. | 313/143 |
| 2008/0093964 | A1 * | 4/2008 | Kawashima | 313/141 |
| 2010/0133978 | A1 * | 6/2010 | Ishida et al. | 313/141 |
| 2011/0254428 | A1 * | 10/2011 | Kyuno et al. | 313/135 |
| 2012/0038263 | A1 * | 2/2012 | Katsuraya et al. | 313/144 |
| 2012/0267995 | A1 * | 10/2012 | Shimamura et al. | 313/143 |
| 2013/0015756 | A1 * | 1/2013 | Yamada et al. | 313/143 |

FOREIGN PATENT DOCUMENTS

| | | | |
|---|---|---|---|
| JP | 4267855 | B | 5/2009 |
| JP | 4268771 | B | 5/2009 |
| JP | 2009-176525 | A | 8/2009 |
| JP | 4548818 | B | 9/2010 |
| WO | WO-2011/125306 | A | 10/2011 |

* cited by examiner

SPARK PLUG

CROSS-REFERENCE TO RELATED PATENT APPLICATIONS

This application is a U.S. National Phase Application under 35 U.S.C. §371 of International Patent Application No. PCT/JP2013/004344, filed Jul. 16, 2013, and claims the benefit of Japanese Patent Applications No. 2012-158280, filed on Jul. 17, 2012, No. 2012-241478, filed Nov. 1, 2012, and No. 2013-147158, filed Jul. 15, 2013, all of which are incorporated by reference in their entirety herein. The International Application was published in Japanese on Jan. 23, 2014 as International Publication No. WO/2014/013723 under PCT Article 21(2).

FIELD OF THE INVENTION

The present invention relates to a spark plug used for ignition in an internal combustion engine and the like.

BACKGROUND OF THE INVENTION

Size reduction of a spark plug is desired for purposes such as increasing the degree of freedom in designing an internal combustion engine. For example, a spark plug with a nominal diameter of the thread of the metal shell of not more than 10 mm has been developed. On the other hand, there are increasing tendencies to desire the airtight and dielectric strength properties of spark plug due to an increase in the compression of fuel gas in internal combustion engines, and an accompanying increase in the voltage applied to the spark plug.

CITATION LIST

Patent Literatures

Patent Document 1: Japanese Patent No. 3502936
Patent Document 2: Japanese Patent No. 4548818
Patent Document 3: Japanese Patent No. 4268771
Patent Document 4: Japanese Patent No. 4267855
Patent Document 5: JP-A-2006-66385
Patent Document 6: JP-A-2009-176525

Problems to be Solved by the Invention

However, when the spark plug is reduced in diameter, it is often difficult to achieve both the airtight and dielectric strength properties of the spark plug due to dimensional limitations and the like.

An object of the present invention is to provide a technique to create a balance between airtight property and dielectric strength property of the spark plug can be achieved.

SUMMARY OF THE INVENTION

Solutions to the Problems

The present invention was made to solve at least some of the problem discussed above, and may be realized as the following embodiments.

Embodiment 1

A spark plug includes: a tubular insulator having an axial hole extending in a direction of an axis thereof (hereinafter, also referred to as an "axial direction"), the tubular insulator having an outer periphery with a tapered outer face where an outer diameter thereof decreases from a rear end to a front end thereof; a tubular metal shell having a through-hole extending in the axial direction through which the insulator is inserted, the tubular metal shell having a thread portion including an installation thread ridge on an outer periphery of the thread portion and a tapered inner face where an inner diameter thereof decreases from the rear end to the front end on an inner periphery of the thread portion; and a circular packing. The circular packing is sandwiched between the tapered outer face of the insulator and the tapered inner face of the metal shell for sealing the gap. The thread portion has a nominal diameter of not more than 10 mm; and at least one cross section including the axis satisfies expressions of: $(A/B)\geq 3.1$, $B\geq 0.25$, and $(A+B)\leq 2.0$. In the equations, A represents a length (mm) of (a difference between an effective diameter of the thread portion and an inner diameter at a rear end of the tapered inner face)/2, and B represents a length (mm) of (a difference between the inner diameter at the rear end of the tapered inner face and an inner diameter at a front end of the tapered inner face)/2.

The greater the length B, the more the area of the tapered inner face of the metal shell increases. Thus, the sealing load required for ensuring a contact pressure necessary for ensuring airtightness becomes large. Thus, in order to decrease the required sealing load, a relatively small length B is preferable. However, when the length B between the inner diameter at the rear end of the tapered inner face and the inner diameter at the front end of the tapered inner face is excessively small, the area of the tapered inner face of the metal shell becomes so small that possibly the tapered outer face of the insulator cannot be supported. If the tapered inner face of the metal shell cannot support the tapered outer face of the insulator, the gap between the tapered outer face of the insulator and the tapered inner face of the metal shell cannot be properly sealed, resulting in a decrease in airtightness. According to the above configuration, $B\geq 0.25$ mm is satisfied, so that the area of the tapered inner face of the metal shell can be ensured, and the insulator can be properly supported.

When the length B is excessively large, the bending moment due to the sealing load becomes large. Further, the greater the length A between the inner diameter at the rear end of the tapered inner face and the effective diameter of the thread portion, the greater the strength of the thread portion with respect to the bending moment becomes. Thus, when the ratio of the length A to the length B (A/B) is excessively small, the strength of the thread portion with respect to the bending moment is insufficient. As a result, the problem of deformation of the thread portion (such as the so-called thread elongation) could be caused. In other words, because of the small strength of the thread portion, it may become impossible to apply the required sealing load. Thus, the contact pressure necessary for ensuring airtightness may not be ensured. According to the above configuration, $(A/B)\geq 3.1$ is satisfied, whereby airtightness can be ensured while suppressing the deformation of the thread portion.

The greater the sum of the length A and the length B (A+B), the smaller the diameter of the insulator inserted into the through-hole of the metal shell becomes. Thus, if (A+B) is excessively large, it may become impossible to ensure the thickness of the insulator in the radial direction, resulting in a decrease in dielectric strength properties. According to the above configuration, because $(A+B)\leq 2.0$ mm is satisfied, the length of the insulator can be ensured, whereby the decrease in dielectric strength properties can be suppressed.

Thus, according to the above configuration, both airtight and dielectric strength properties of the spark plug can be achieved. Particularly, the airtight and dielectric strength properties of the spark plug including the thread portion with the nominal diameter of not more than 10 mm can be achieved.

Embodiment 2

The spark plug according to Embodiment 1, wherein the length A satisfies $1.23 \leq A \leq 1.54$, and the length B satisfies $0.25 \leq B \leq 0.45$.

According to the above configuration, by making the length A and the length B more appropriate, airtight and dielectric strength properties of the spark plug can be even more improved without causing insulator penetration or thread portion deformation.

Embodiment 3

The spark plug according to Embodiment 1 or Embodiment 2, wherein the tapered inner face of the metal shell and a plane perpendicular to the axis form an acute angle of not less than 35 degrees and not more than 50 degrees, and is greater than an acute angle formed by the tapered outer face of the insulator and the plane perpendicular to the axis.

When the acute angle (which may be referred to as the first acute angle) formed by the tapered inner face of the metal shell and the plane perpendicular to the axis is excessively small, the sealing load in the axial direction tends to become large, whereby a part of the metal shell around the radially inner side of the tapered inner face tends to be deformed. Further, when the first acute angle is not more than the acute angle (which may be referred to as the second acute angle) formed by the tapered outer face of the insulator and the plane perpendicular to the axis, a large load tends to be applied onto the radially inner part of the tapered inner face of the metal shell, so that similarly the metal shell tends to be deformed in the radially inner part of the tapered inner face. If the radially inner part of the tapered inner face of the metal shell is deformed, the part and the insulator may contact each other, possibly resulting in the problem of insulator breakage. If the first acute angle is excessively large, the sealing load tends to be increased toward the radially outer side, and deformation of the thread portion may be caused. According to the above configuration, the first acute angle is not less than 35 degrees and not more than 50 degrees and greater than the second acute angle. Thus, insulator breakage or deformation of the thread portion due to the sealing load can be suppressed.

Embodiment 4

The spark plug according to any one of Embodiments 1 to 3, wherein $15 \leq (E-F) \leq 46$ is satisfied, where E (Hv) is the Vickers hardness of a portion of the metal shell in which the tapered inner face is formed, and F (Hv) is the Vickers hardness of the packing.

When the difference between the hardness E and the hardness F (E−F) is excessively large; namely, when the packing is excessively soft, the amount of deformation of the packing may become excessive, possibly resulting in insulator breakage due to deformation of the packing. When the difference between the hardness E and the hardness F (E−F) is excessively small; namely, when the packing is excessively hard, the amount of deformation of the packing may become insufficient, and an excessive load may be applied to the tapered inner face of the metal shell, possibly causing deformation of the thread portion. According to the above configuration, the difference between the hardness E and the hardness F (E−F) satisfies $15\ Hv \leq (E-F) \leq 46\ Hv$, whereby insulator breakage or deformation of the thread portion can be suppressed.

The present invention can be realized in various modes, such as in the form of a spark plug, or an internal combustion engine fitted with the spark plug.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

A. Embodiment

A-1. Configuration of Spark Plug

Figure 1:
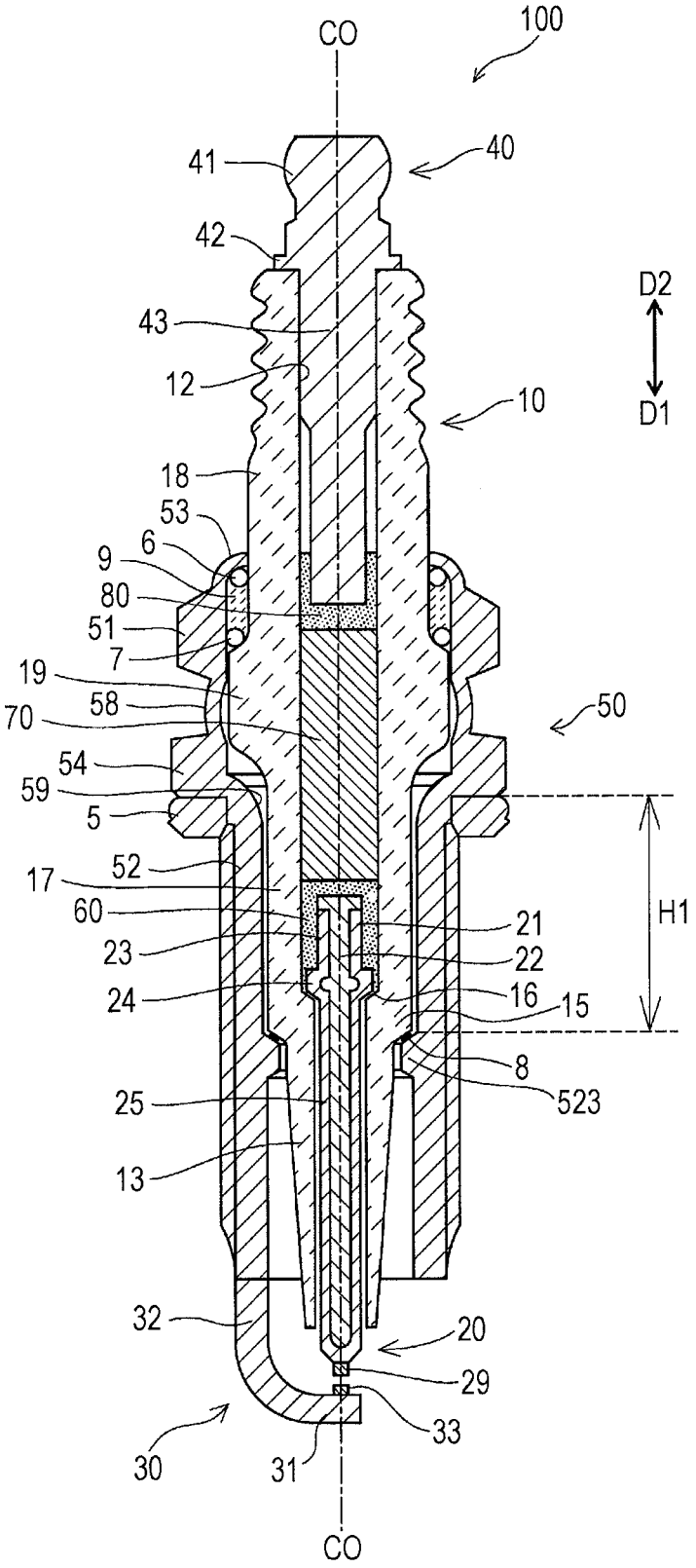
FIG. 1 is a cross sectional view of a spark plug 100 according to the present embodiment.

In the following, various modes for carrying out the present invention will be described with reference to an embodiment. FIG. 1 is a cross sectional view of a spark plug 100 according to the embodiment. In FIG. 1, the dash-dot line indicates an axis CO (which may also be referred to as an axis CO) of the spark plug 100. A direction parallel with the axis CO (upper-lower direction in FIG. 1) may also be referred to as the axial direction. A radial direction of a circle about the axis CO may be simply referred to as the radial direction, and a circumferential direction of the circle about the axis CO may simply be referred to as the circumferential direction. In FIG. 1, a lower direction may be referred to as a front end direction D1, while an upper direction may be referred to as a rear end direction D2. The lower side of FIG. 1 will be referred to as the front end of the spark plug 100, and the upper side of FIG. 1 will be referred to as the rear end of the spark plug 100. The spark plug 100 includes a ceramic insulator 10 as an insulator, a center electrode 20, a ground electrode 30, a terminal metal fitting 40, and a metal shell 50.

The ceramic insulator 10 is formed by sintering alumina and the like. The ceramic insulator 10 is a substantially cylindrical member (tubular member) extending along the axial direction and including a through-hole 12 (axial hole) penetrating the ceramic insulator 10. The ceramic insulator 10 includes a flange portion 19, a rear end body portion 18, a front end body portion 17, a step portion 15, and an insulator nose portion 13. The rear end body portion 18 is located backward from the flange portion 19, and has an outer diameter smaller than an outer diameter of the flange portion 19. The front end body portion 17 is located forward of the flange portion 19, and has an outer diameter smaller than the outer diameter of the rear end body portion 18. The insulator nose portion 13 is located forward of the front end body portion 17, and has an outer diameter smaller than the outer diameter of the front end body portion 17. The insulator nose portion 13 has an increasingly smaller diameter toward the front end, and is exposed in the combustion chamber of an internal combustion engine (not shown) when the spark plug 100 is installed thereon. The step portion 15 is formed between the insulator nose portion 13 and the front end body portion 17. The step portion 15 includes a tapered outer face (15*a* in FIG. 2) on an outer periphery thereof, with an increasingly smaller outer diameter from the rear end to the front end (as will be described in detail below).

The metal shell 50 is a substantially cylindrical member (tubular member) formed of an electrically conductive metal material (such as low carbon steel material) for fixing the spark plug 100 on the engine head (not shown) of the internal combustion engine. The metal shell 50 has a through-hole 59 penetrating the metal shell 50 along the axis CO. The metal shell 50 is disposed on the outer periphery of the ceramic insulator 10. Namely, the insulator 10 is inserted and held within the through-hole 59 of the metal shell 50. The front end of the ceramic insulator 10 is exposed on the front end of the metal shell 50. The rear end of the ceramic insulator 10 is exposed on the rear end of the metal shell 50.

The metal shell 50 includes a hexagonal-columnar tool engaging portion 51 for engaging a spark plug wrench, an installation thread portion 52 for installing on the internal combustion engine, and a flange-shaped seating portion 54 formed between the tool engaging portion 51 and the installation thread portion 52. The installation thread portion 52 has a nominal diameter of not more than M10 (10 mm (millimeters)). For example, the nominal diameter of the installation thread portion 52 is preferably M10 or M8, and is more preferably M10.

Between the installation thread portion 52 and the seating portion 54 of the metal shell 50, a circular gasket 5 formed of a bent metal sheet is fitted. The gasket 5 seals a gap between the spark plug 100 and the internal combustion engine (engine head) when the spark plug 100 is installed on the internal combustion engine.

The metal shell 50 further includes a thin-walled crimping portion 53 disposed on the rear end of the tool engaging portion 51, and a thin-walled compressive deformation portion 58 disposed between the seating portion 54 and the tool engaging portion 51. In a ringed area formed between the inner periphery of a portion of the metal shell 50 extending from the tool engaging portion 51 to the crimping portion 53 and the outer periphery of the rear end body portion 18 of the ceramic insulator 10, circular ring members 6 and 7 are disposed. Between the two ring members 6 and 7 in this area, talc powder 9 is filled. The installation thread portion 52 of the metal shell 50 includes a shelf portion 523 protruding inwardly of the installation thread portion 52. The shelf portion 523 includes a tapered inner face (523*a* in FIG. 2) on the inner periphery thereof, with an increasingly smaller outer diameter from the rear end to the front end (as will be described in detail below).

The rear end of the crimping portion 53 is bent radially inwardly and fixed onto the outer periphery of the ceramic insulator 10. At the time of manufacturing, the compressive deformation portion 58 of the metal shell 50 is compressively deformed as the crimping portion 53 fixed onto the outer periphery of the ceramic insulator 10 is pressed toward the front end. The weight with which the crimping portion 53 is pressed toward the front end during manufacturing is referred to as a crimping load. By the compressive deformation of the compressive deformation portion 58, the ceramic insulator 10 is pressed toward the front end within the metal shell 50 via the ring members 6 and 7 the talc 9. As a result, the step portion 15 of the ceramic insulator 10 is pressed onto the shelf portion 523 of the metal shell 50 via the circular plate packing 8. Namely, as will be described in detail below, a gap between the tapered outer face of the step portion 15 and the tapered inner face the shelf portion 523 is sealed via the plate packing 8. As a result, the gas in the combustion chamber of the internal combustion engine is prevented from leaking outside via the gap between the metal shell 50 and the ceramic insulator 10 by the plate packing 8. Preferably, in the metal shell 50, a length H1 of not less than 14.3 mm is ensured between the front end face (which may be referred to as a seating face) of the seating portion 54 and the rear end of the shelf portion 523.

The plate packing 8 is formed of a high thermal conductivity material, such as copper or aluminum. When the plate packing 8 has high thermal conductivity, the heat of the ceramic insulator 10 can be efficiently transmitted to the shelf portion 523 of the metal shell 50, so that the heat conduction of the spark plug 100 is improved and thermal resistance can be increased.

The center electrode 20 is a bar-like member extending along the axis CO and inserted in the through-hole 12 of the insulator 10. The center electrode 20 has a structure including an electrode base material 21 and a core material 22 embedded inside the electrode base material 21. The electrode base material 21 is formed of nickel or an alloy with nickel as a principal component (such as INCONEL (registered trademark) 600). The core material 22 is formed of a material with better thermal conductivity than the alloy of the electrode base material 21, such as copper or an alloy with copper as a principal component. The front end of the center electrode 20 is exposed on the front end of the ceramic insulator 10.

The center electrode 20 also includes a flange portion 24 (which may be referred to as an electrode flange portion or a flanged portion) disposed at a predetermined position in the axial direction, a head portion 23 (electrode head portion) disposed on the rear end with respect to the flange portion 24, and a nose portion 25 (electrode nose portion) disposed on the front end with respect to the flange portion 24. The flange portion 24 is supported by a step portion 16 of the ceramic insulator 10. At the front end portion of the nose portion 25 of the center electrode 20, an electrode tip 29 is joined by laser welding, for example. The configuration of the front end portion of the nose portion 25 of the center electrode 20 will be described below with reference to FIGS. 2 and 3. The electrode tip 29 is formed of a material with a high melting point noble metal as a principal component. The material of the electrode tip 29 may include iridium (Ir) or an alloy with Ir as a principal component. Specifically, Ir-5Pt alloy (an iridium alloy containing 5% by mass of platinum) and the like is often used.

The ground electrode 30 is joined to the front end of the metal shell 50. The electrode base material of the ground electrode 30 is formed of a highly corrosion resistant metal, such as the INCONEL 600 nickel alloy. The ground electrode 30 includes a base material proximal end portion 32 that is joined to the front end face of the metal shell 50 by welding, for example. As a result, the ground electrode 30 is electrically connected to the metal shell 50. The base material front end portion 31 of the ground electrode 30 is bent such that one side face of the base material front end portion 31 is disposed axially opposite the electrode tip 29 of the center electrode 20 on the axis CO. On the one side face of the base material front end portion 31, an electrode tip 33 is welded at a position opposite the electrode tip 29 of the center electrode 20. For the electrode tip 33, Pt (platinum) or an alloy with Pt as a principal component, such as Pt-20Ir alloy (a platinum alloy containing 20% by mass of iridium) is used, for example.

Between the electrode tip 29 of the center electrode 20 and the electrode tip 33 of the ground electrode 30, a spark gap is formed.

The terminal metal fitting 40 is a bar-like member extending along the axis CO. The terminal metal fitting 40 is formed of an electrically conductive metal material (such as low carbon steel), with a metal layer (such as a Ni layer) formed on the surface thereof by plating, for example, for corrosion prevention. The terminal metal fitting 40 includes a flange portion 42 (terminal chin portion) disposed at a predetermined position in the axial direction, a cap installing portion 41 located backward from the flange portion 42, and a nose portion 43 (terminal nose portion) disposed on the front end with respect to the flange portion 42. The cap installing portion 41 including the rear end of the terminal metal fitting 40 is exposed on the rear end of the ceramic insulator 10. The nose portion 43 including the front end of the terminal metal fitting 40 is inserted (press-fitted) into the through-hole 12 of the ceramic insulator 10. The cap installing portion 41 is configured to be fitted with a plug cap connected to a high-voltage cable (not shown) to apply a high voltage for producing a spark.

In the through-hole 12 of the ceramic insulator 10, in an area between the front end of the terminal metal fitting 40 and the rear end of the center electrode 20, a resistor element 70 for reducing radio interference noise at the time of spark generation is disposed. The resistor is formed of a composition including, for example, glass particles as a principal component, ceramic particles other than glass, and an electrically conductive material. A gap between the resistor element 70 and the center electrode 20 in the through-hole 12 is filled with an electrically conductive seal 60. A gap between the resistor element 70 and the terminal metal fitting 40 is filled with an electrically conductive seal 80 of glass and metal.

Figure 2:
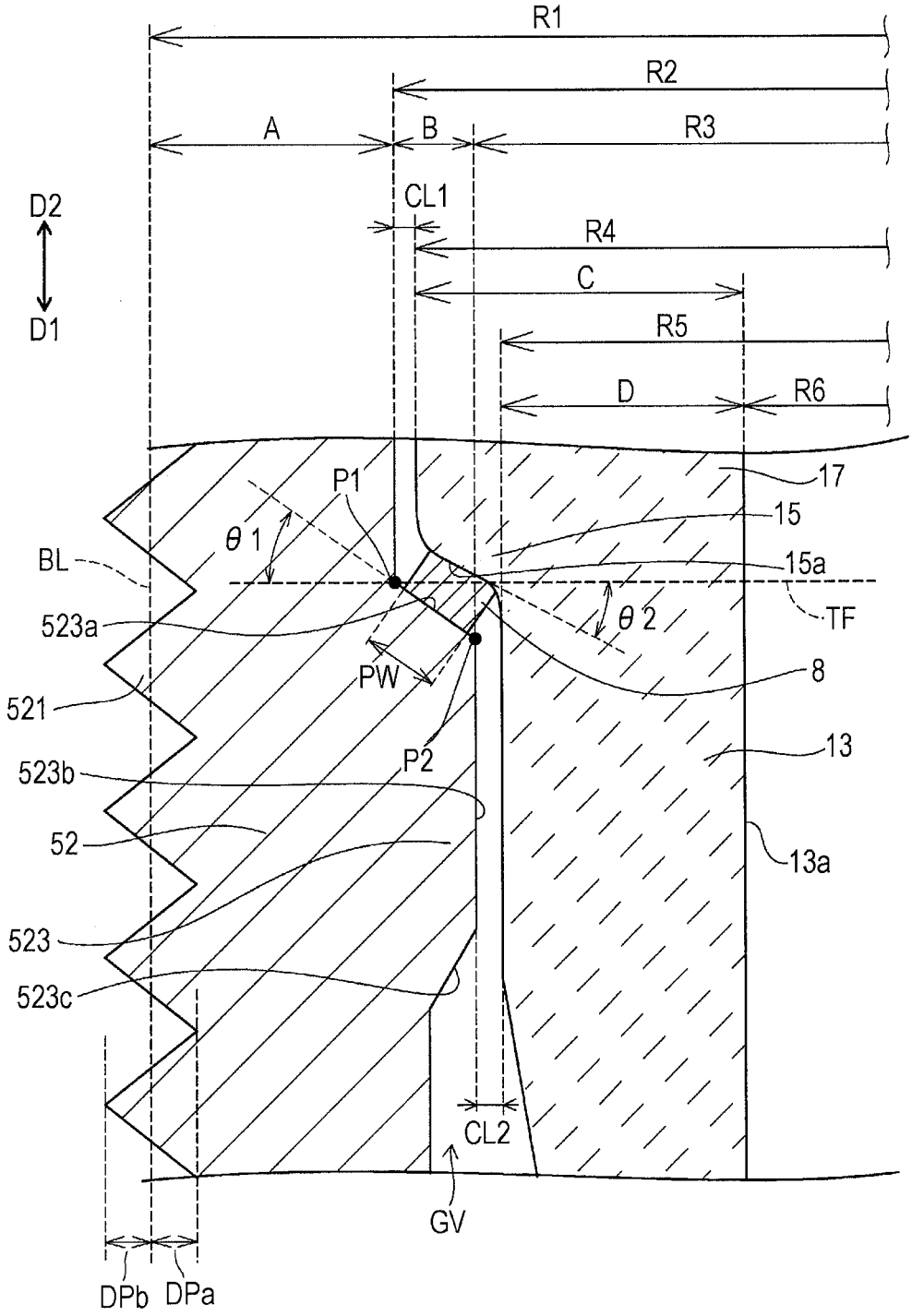
FIG. 2 is an enlarged cross sectional view of a portion including a shelf portion 523 of an installation thread portion 52 of a metal shell 50 and a step portion 15 of a ceramic insulator 10.

A-2. Configuration of Metal Shell Around Shelf Portion of Installation Thread Portion FIG. 2 is an enlarged cross sectional view of a portion including the shelf portion 523 of the installation thread portion 52 of the metal shell 50 and the step portion 15 of the ceramic insulator 10. This view is that of a cross section of the spark plug 100 taken along a plane including the axis CO. On the outer periphery of the installation thread portion 52, mounting thread ridges 521 are formed. A dashed line BL in FIG. 2 indicates a virtual outer periphery (which may also be referred to as an effective diameter defining plane BL) defining an effective diameter R1 of the installation thread portion 52. The effective diameter defining plane BL is a virtual outer periphery such that a root depth DPa from the root of the thread ridges 521 to the effective diameter defining plane BL is equal to a crest height DPb from the crest of the thread ridges 521 to the effective diameter defining plane BL. When the installation thread portion 52 has a nominal diameter of 10 mm, the effective diameter R1 is approximately 9.3 mm.

The shelf portion 523 of the installation thread portion 52 includes the tapered inner face 523*a* described above, an inner side face 523*b*, and an inversely tapered inner face 523*c*. The tapered inner face 523*a* is an inner periphery of a rear end portion of the shelf portion 523 where the inner diameter thereof gradually decreases from the rear end to the front end thereof. The inversely tapered inner face 523*c* is an inner periphery of a front end portion of the shelf portion 523 where the inner diameter thereof gradually increases from the rear end to the front end thereof. The inner side face 523*b* is an inner periphery extending from the front end of the tapered inner face 523*a* to the rear end of the inversely tapered inner face 523*c*, and is parallel with the axial direction. The terms "inner diameter" and "outer diameter" as used herein each refer to a straight line segment passing through the center.

The tapered inner face 523*a* has an inner diameter R2 at a rear end P1. In other words, the inner diameter R2 may be the inner diameter of the installation thread portion 52 at a portion backward from the rear end P1 of the shelf portion 523. The tapered inner face 523*a* has an inner diameter R3 at a front end P2. The inner diameter R3 may be the inner diameter of the inner side face 523*b*.

A length A in the radial direction of a portion of the installation thread portion 52 backward from the rear end P1 of the tapered inner face 523*a* may be expressed as one half of the difference between the effective diameter R1 of the installation thread portion 52 and the inner diameter R2 at the rear end P1 of the tapered inner face 523*a*. Namely, the length A (FIG. 2) can be expressed as A=(R1−R2)/2. The length A may also be referred to as a thread portion thickness A.

Further, a length B in the radial direction of the shelf portion 523 may be expressed as one half of the difference between the inner diameter R2 at the rear end P1 of the tapered inner face 523*a* and the inner diameter R3 at the front end P2 of the tapered inner face 523*a*. Namely, the length B (FIG. 2) can be expressed as B=(R2−R3)/2. The length B may also be referred to as a shelf thickness B.

In the cross section of FIG. 2, an acute angle formed by the tapered inner face 523*a* of the shelf portion 523 and a virtual plane TF perpendicular to the axis CO (FIG. 1) is referred to as a first acute angle 91.

The front end body portion 17 of the ceramic insulator 10 has an outer diameter R4 smaller than the inner diameter R2 by (2×CL1) such that a predetermined clearance CL1 (such as 0.05 mm to 0.45 mm) can be ensured between the front end body portion 17 and the opposite inner periphery of the metal shell 50 with the inner diameter R2 (R4=R2−(2×CL1)). An inner diameter R6 at an inner periphery 13*a* of the through-hole 12 in the front end body portion 17 and the insulator nose portion 13 is determined in accordance with the outer diameter of the nose portion 25 (not shown in FIG. 2) of the center electrode 20 inserted into the through-hole 12. Preferably, the inner diameter R6 is in a range of 1.5 mm to 1.8 mm, for example. A length C in the radial direction of the front end body portion 17 (thickness of the portion of the ceramic insulator 10) can be expressed as one half of the difference between the outer diameter R4 and the inner diameter R6. Namely, the length C (FIG. 2) can be expressed as C=(R4−R6)/2.

An outer diameter R5 of a part of the insulator nose portion 13 of the ceramic insulator 10 opposite the shelf portion 523 of the metal shell 50 is smaller than the inner diameter R3 of the shelf portion 523 by (2×CL2) such that a predetermined clearance CL2 (such as 0.15 mm to 0.6 mm) can be ensured between the part and the shelf portion 523 of the metal shell 50 (R5=R3−(2×CL2)). A length D in the radial direction of a part of the insulator nose portion 13 opposite the shelf portion 523 of the metal shell 50 (the thickness of the part of the ceramic insulator 10) can be expressed as one half of the difference between the outer diameter R5 and the inner diameter R6. Namely, the length D (FIG. 2) can be expressed as D=(R5−R6)/2. The lengths C and D may also be referred to as insulation thicknesses C and D, respectively. The greater the insulation thicknesses C and D, the more the dielectric strength properties of the spark plug 100 is improved.

The step portion 15 of the ceramic insulator 10 includes the tapered outer face 15*a* on the outer periphery thereof, with an increasingly smaller outer diameter from the rear end to the front end. In the cross section of FIG. 2, an acute angle formed by the tapered outer face 15*a* of the step portion 15 and the virtual plane TF perpendicular to the axis CO (FIG. 1) is referred to as a second acute angle θ2. In the cross section of FIG. 2, while the portions of the tapered outer face 15*a* around the front and rear ends are curved, the central portion between the curves at the front and rear ends is linear. The second acute angle θ2 is determined based on the linear part of the central portion.

The circular plate packing 8 sandwiched between the tapered inner face 523*a* of the shelf portion 523 and the tapered outer face 15*a* of the step portion 15 of the ceramic insulator 10 is compressed in the axial direction by the sealing load corresponding to the crimping load, as described above. The plate packing 8 is compressively deformed by the sealing load along the tapered inner face 523*a*. In the cross section of FIG. 2, a width PW in a direction along the tapered inner face 523*a* is approximately 100% of the linear length of the tapered inner face 523*a* in the cross section of FIG. 2, for example, and may preferably be in a range of 0.38 mm to 0.86 mm.

A-3: First Evaluation Test

In a first evaluation test, eleven kinds of samples of the spark plug 100 with the nominal diameter of the installation thread portion 52 of 10 mm were used. In the eleven kinds of samples, the metal shell 50 had various thread portion thicknesses A and shelf thicknesses B.

In the first evaluation test, a crimping test and a dielectric strength test were conducted. In the crimping test, the metal shell 50 was crimped by using 34 kN (kilo newton) of crimping load, and the presence or absence of the problem of the step portion 15 of the ceramic insulator 10 slipping from the shelf portion 523 of the metal shell 50 toward the front end (which may be hereafter referred to as slipping), and the presence or absence of the problem of the thread ridges 521 of the installation thread portion 52 of the metal shell 50 being deformed (which may hereafter be referred to as thread elongation) were tested. The presence or absence of slipping can be visually confirmed, while the presence or absence of thread elongation can be confirmed by using a thread gauge. When neither thread elongation nor slipping was present, the sample was evaluated as "Good". When either thread elongation or slipping was present, the sample was evaluated as "Poor".

In the dielectric strength test, the samples in which the ground electrode 30 was not bent toward the front end of the center electrode 20 were used so that no discharge was produced between the electrode tip 33 of the ground electrode 30 and the electrode tip 29 of the center electrode 20. Further, in these samples, a space GV between the metal shell 50 and the ceramic insulator 10 on the front end with respect to the plate packing 8 was filled with an insulating fluid so that no discharge was produced between the center electrode 20 and the ground electrode 30. A voltage was applied between the terminal metal fitting 40 and the metal shell 50 of the samples, and the applied voltage was increased until insulator penetration (dielectric breakdown) was caused. When the voltage at which insulator penetration occurred (which is referred to as a penetration voltage) was 25 kV (kilovolts) or higher, the sample was evaluated as "Good". When the penetration voltage was lower than 25 kV, the sample was evaluated as "Poor". The evaluation results are shown in Table 1. In Table 1, the unit of the thread portion thickness A and the shelf thickness B is millimeters.

TABLE 1

| Sample No. | A | B | A/B | A + B | Crimping test | Dielectric strength test |
|---|---|---|---|---|---|---|
| 1-1 | 1.30 | 0.20 | 6.5 | 1.50 | Poor (Slipping) | Good |
| 1-2 | 1.23 | 0.25 | 4.9 | 1.48 | Good | Good |
| 1-3 | 1.38 | 0.40 | 3.5 | 1.78 | Good | Good |
| 1-4 | 1.53 | 0.25 | 6.1 | 1.78 | Good | Good |
| 1-5 | 1.38 | 0.45 | 3.1 | 1.83 | Good | Good |
| 1-6 | 1.13 | 0.50 | 2.3 | 1.63 | Poor (Thread extension) | Good |
| 1-7 | 1.28 | 0.30 | 4.3 | 1.58 | Good | Good |
| 1-8 | 1.28 | 0.45 | 2.9 | 1.73 | Poor (Thread extension) | Good |
| 1-9 | 1.54 | 0.45 | 3.4 | 1.99 | Good | Good |
| 1-10 | 1.60 | 0.40 | 4.0 | 2.00 | Good | Good |
| 1-11 | 1.70 | 0.40 | 4.1 | 2.10 | Good | Poor |

It can be seen from the test results shown in Table 1 that no slipping was caused in the samples (1-2) to (1-11) with the shelf thickness B of not less than 0.25 mm, while slipping was caused in the sample (1-1) with the shelf thickness B of less than 0.25 mm. It is thought that when the shelf thickness B is less than 0.25 mm, the area of the tapered inner face 523*a* of the metal shell 50 is so small that the tapered outer face 15*a* of the ceramic insulator 10 cannot be supported. When the tapered inner face 523*a* of the metal shell 50 cannot support the tapered outer face 15*a* of the ceramic insulator 10, the gap between the tapered outer face 15*a* of the ceramic insulator 10 and the tapered inner face 523*a* of the metal shell 50 cannot be properly sealed, resulting in a decrease in airtightness. Thus, it is seen from the test results that it is preferable to ensure the shelf thickness B of not less than 0.25.

Further, it is seen that no thread elongation was caused in the samples (1-1) to (1-5), (1-7), and (1-9) to (1-11) with the ratio of the thread portion thickness A to the shelf thickness B (A/B) of not less than 3.1, while thread elongation was caused in the samples (1-6) and (1-8) with the ratio (A/B) of less than 3.1. This is presumably due to the following reasons.

Figure 3:
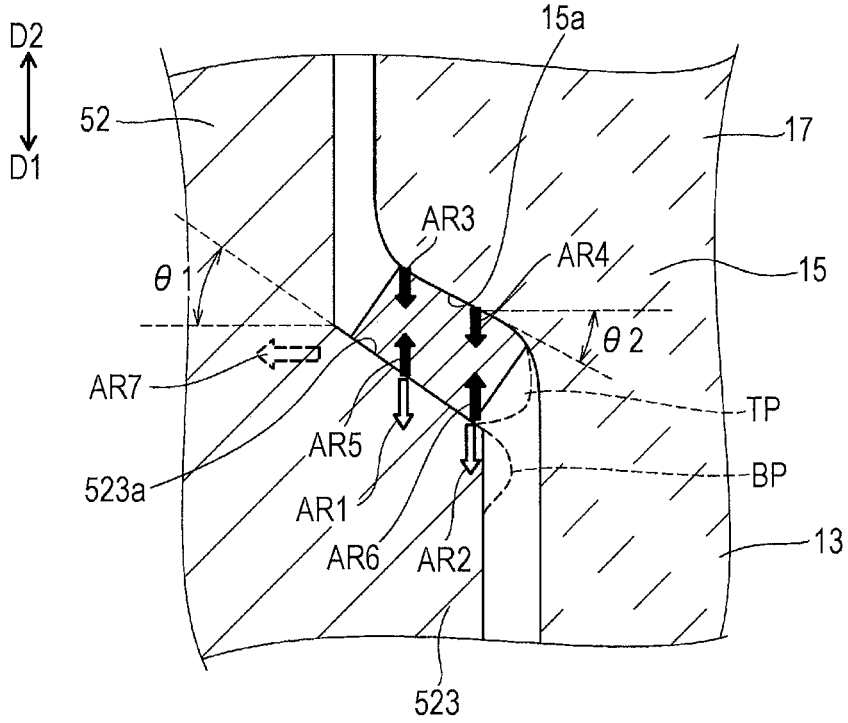
FIG. 3 is a diagram explaining a stress loaded onto the portion including the shelf portion 523 of the installation thread portion 52 and the step portion 15 of the ceramic insulator 10.

FIG. 3 is a diagram explaining the stress loaded onto a portion including the shelf portion 523 of the installation thread portion 52 and the step portion 15 of the ceramic insulator 10. By the crimping load, the shelf portion 523 is subjected to stress toward the front end, as indicated by white arrows AR1 and AR2 in FIG. 3. The greater the shelf thickness B, the greater the bending moment that would bend the installation thread portion 52 in the radial direction based on the stress. Also, the greater the thread portion thickness A, the greater the strength of the installation thread portion 52 with respect to the bending moment. Thus, it is thought that, when the ratio (A/B) is less than 3.1, the strength of the installation thread portion 52 with respect to the bending moment is insufficient, resulting in the problem of deformation of the installation thread portion 52, specifically the development of thread elongation, for example. In other words, it is possible that the necessary crimping load cannot be applied due to the lack of strength of the installation thread portion 52, so that the contact pressure required for ensuring airtightness cannot be obtained. Accordingly, the ratio (A/B) is preferably not less than 3.1 .

Further, in the samples (1-1) to (1-10) with the sum of the thread portion thickness A and the shelf thickness B (A+B) of not more than 2.0 mm, the evaluation of the dielectric strength test was "Good", while in the sample (1-11) with (A+B) exceeding 2.0 mm, the dielectric strength test evaluation was "Poor". This is presumably due to the following reasons.

For example, when the nominal diameter of the installation thread portion 52 is a fixed value (such as 10 mm), the greater A or (A+B), the smaller the inner diameter R3 of the shelf portion 523 of the metal shell 50 becomes. Then, the insulation thicknesses C and D (FIG. 2) of the ceramic insulator 10 are decreased. As a result, the insulation thicknesses C and D of the ceramic insulator 10 cannot be ensured, and the dielectric strength properties may be decreased. When (A+B) is greater than 2.0 mm, therefore, A or (A+B) is excessively large and therefore the insulation thickness C or D is excessively small, resulting in a decrease in dielectric strength properties. Thus, it is clear that (A+B) is preferably less than 2.0 mm.

Further, when (A+B) is excessively large, the shelf thickness B may become large even when the ratio (A/B) is not less than 3.1, resulting in an increase in the area of the tapered inner face 523*a*. As a result, the area of the tapered inner face 523*a* may become so large that, in order to ensure the required sealing pressure (the load per unit area) between the tapered inner face 523*a* and the plate packing 8, the crimping load may need to be increased. From this viewpoint too, a relatively small (A+B) is preferable.

Thus, from the test results of the first evaluation test (Table 1), the thread portion thickness A and the shelf thickness B preferably satisfy (A/B)≥3.1, B≥0.25, and (A+B)≤2.0. In this way, both dielectric strength property and airtightness can be achieved in the spark plug 100.

As will be seen from the above description, the differences between the samples in the test results of the evaluation test are presumably due mainly to the differences in the thread portion thickness A and the shelf thickness B. Thus, the above preferable ranges of the thread portion thickness A and the shelf thickness B are presumed to be applicable regardless of the configuration other than the thread portion thickness A and the shelf thickness B.

A-4: Second Evaluation Test

In a second evaluation test, six kinds of samples satisfying the preferable ranges clarified by the first evaluation test were prepared, and the crimping test and the dielectric strength test were conducted under even more strict conditions than in the first evaluation test. Namely, in the second evaluation test, six kinds of samples of the spark plug 100 with the nominal diameter of the installation thread portion 52 of 10 mm were used. In these six kinds of samples, the metal shell 50 had various thread portion thicknesses A and shelf thicknesses B.

In the crimping test according to the second evaluation test, the metal shell 50 of each sample was crimped by using 36 kN of crimping load. The evaluation method was the same as for the crimping test according to the first evaluation test.

In the dielectric strength test according to the second evaluation test, a test similar to the dielectric strength test according to the first evaluation test was conducted. In the second evaluation test, when the penetration voltage was 30 kV (kilovolts) or higher, the sample was evaluated to be "Good". When the penetration voltage was lower than 30 kV, the sample was evaluated to be "Poor". The evaluation results are shown in Table 2. In Table 2, the unit of the thread portion thickness A and the shelf thickness B is millimeters.

TABLE 2

| Sample No. | A | B | Crimping test | Dielectric strength test |
|---|---|---|---|---|
| 2-1 | 1.15 | 0.35 | Poor (Thread extension) | Good |
| 2-2 | 1.23 | 0.30 | Good | Good |
| 2-3 | 1.38 | 0.35 | Good | Good |
| 2-4 | 1.50 | 0.45 | Good | Good |
| 2-5 | 1.54 | 0.35 | Good | Good |
| 2-6 | 1.60 | 0.40 | Good | Poor |

From the test results shown in Table 2, it is seen that no thread elongation was caused in the sample (2-2) to (2-6) with the thread portion thickness A of not less than 1.23 mm, while thread elongation was caused in the sample (2-1) with the thread portion thickness A of less than 1.23 mm. It is thought that when the thread portion thickness A is less than 1.23 mm in the case of the crimping load of the second evaluation test, the thread portion thickness A is so small that the strength of the installation thread portion 52 with respect to the bending moment is insufficient, resulting in thread elongation. Accordingly, from the test results, the thread portion thickness A is preferably not less than 1.23 mm.

Further, it is seen that in the samples (2-1) to (2-5) with the thread portion thickness A of not more than 1.54 mm, the dielectric strength test evaluation was "Good", while in the sample (2-6) with the thread portion thickness A exceeding 1.54 mm, the dielectric strength test evaluation was "Poor". This is presumably due to the fact that, when the thread portion thickness A exceeds 1.54 mm, the insulation thicknesses C and D (FIG. 2) cannot be ensured, resulting in a decrease in dielectric strength property. Thus, it is more preferable that the thread portion thickness A is not more than 1.54 mm.

From the test results shown in Table 2, it is seen that as long as the thread portion thickness A is not less than 1.23 mm and not more than 1.54 mm, the shelf thickness B may have any value between 0.30 or more and 0.45 mm or less. Thus, the differences in the evaluation results in the second test are thought to be mainly due to the thread portion thickness A.

While it has been clarified from the first evaluation test that preferably (A/B)≥3.1, B≥0.25, and (A+B)≤2.0, it will be understood that solving the three inequalities with respect to B yields 0.25≤B≤about 0.48. It is thought that from this inequality and the test results shown in Table 2, the shelf thickness B may preferably be in a range of at least 0.25≤B≤0.45.

Thus, from the test results of the second evaluation test (Table 2), it is more preferable that the thread portion thickness A and the shelf thickness B satisfy 1.23 mm≤A≤1.54 mm and 0.25≤B≤0.45, respectively. In this way, in the spark plug 100, both dielectric strength property and airtightness can be satisfied at higher level. Namely, by further making the length A and the length B appropriate, the airtight and dielectric strength properties of the spark plug can be even more improved without causing insulator penetration or thread portion deformation.

For example, it is particularly preferable that, in the spark plug 100 with the nominal diameter of the installation thread portion 52 of 10 mm (effective diameter R1=9.268 mm), the thread portion thickness A=1.41 mm and the shelf thickness B=0.43 mm. In this way, the outer diameter R4 of the front end body portion 17 of the ceramic insulator 10 (FIG. 2) is 6.25 mm, and the inner diameter R3 at the front end P2 of the tapered inner face 523*a* (inner diameter of the inner side face 523*b* of the shelf portion 523) (FIG. 2) is 5.6 mm. Thus, airtight and dielectric strength properties of the spark plug 100 can be sufficiently achieved.

A-5: Third Evaluation Test

In a third evaluation test, five kinds of samples satisfying the more preferable ranges clarified by the second evaluation test were prepared, and the crimping test was conducted with even more strict conditions than in the second evaluation test. Namely, in the third evaluation test, five kinds of samples of the spark plug 100 with the nominal diameter of the installation thread portion 52 of 10 mm, the thread portion thickness A=1.38 mm, and the shelf thickness B=0.35 mm were used. In these five kinds of samples, the second acute angle θ2 was fixed at 30 degrees, and the first acute angle θ1 was set at different angles.

The first acute angle θ1 was set to be greater than the second acute angle θ2 (θ1>θ2). It is obvious, without even performing a test, that θ1>θ2 is more preferable than θ1≤θ2, as described below.

As shown in FIG. 3, when θ1≤θ2, the interval between the tapered inner face 523*a* of the shelf portion 523 and the tapered outer face 15*a* of the ceramic insulator 10 becomes narrower toward the radially inner side. As a result, the compressive force at the radially inner side portion of the plate packing 8 (see arrows AR4 and AR6 in FIG. 3) becomes greater than the compressive force at the radially outer side portion of the plate packing 8 (see arrows AR3 and AR5 in FIG. 3). Thus, the plate packing 8 may be deformed and protrude into the radially inner side (see a dashed line TP in FIG. 3), possibly damaging the ceramic insulator 10. The same can be said of the stress applied to the tapered inner face 523*a* (see arrows AR1 and AR2 in FIG. 3). Namely, the stress applied to the radially inner side portion of the tapered inner face 523*a* (arrow AR2 in FIG. 3) becomes greater than the stress applied to the radially outer side portion of the tapered inner face 523*a* (arrow AR1 in FIG. 3). As a result, the shelf portion 523 is deformed in such a manner as to protrude into the radially inner side (see a dashed line BP in FIG. 3), possibly damaging the ceramic insulator 10. Thus, the first acute angle θ1 is preferably set to be greater than the second acute angle θ2 (θ1>θ2).

In the crimping test of the third evaluation test, the metal shell 50 of each sample was crimped by using 38 kN of crimping load. Then, the presence or absence of thread elongation in the sample, and the presence or absence of breakage of the ceramic insulator 10 after crimping were evaluated. The presence or absence of thread elongation was confirmed by using a thread gauge. The presence or absence of breakage in the ceramic insulator 10 was visually confirmed after applying red checking liquid to the ceramic insulator 10 for visualizing breakage. The evaluation results are shown in Table 3. In Table 3, "Good" indicates the absence of thread elongation or breakage in the ceramic insulator 10, and "Poor" indicates the presence of thread elongation or breakage in the ceramic insulator 10.

TABLE 3

| Sample No. | θ1 | θ2 | Thread extension | Insulator breakage |
|---|---|---|---|---|
| 3-1 | 31 | 30 | Good | Poor |
| 3-2 | 35 | 30 | Good | Good |
| 3-3 | 40 | 30 | Good | Good |
| 3-4 | 50 | 30 | Good | Good |
| 3-5 | 54 | 30 | Poor | Good |

In the test results shown in Table 3, no breakage in the ceramic insulator 10 was caused in the samples (3-2) to (3-5) with the first acute angle θ1 of 35 degrees or more, while insulator breakage was caused in the sample (3-1) with the first acute angle θ1 of less than 35 degrees. In the samples (3-1) to (3-4) with the first acute angle θ1 of not more than 50, no thread elongation was caused, while in the sample (3-5) with the first acute angle θ1 exceeding 50 degrees, thread elongation was caused. These are presumably due to the following reasons.

The stress applied to the shelf portion 523 based on the crimping load can be resolved into a component parallel to the axial direction (arrows AR1 and AR2 in FIG. 3), and a component perpendicular to the axis (arrow AR7 in FIG. 3). The smaller the first acute angle θ1, the greater the component parallel to the axial direction becomes. The greater the first acute angle θ1, the greater the component perpendicular to the axis becomes.

When the first acute angle θ1 is less than 35 degrees, the component parallel to the axis (arrows AR1 and AR2 in FIG. 3) becomes too large. As a result, the shelf portion 523 may be deformed in such a manner as to protrude toward the radially inner side (see the dashed line BP in FIG. 3), damaging the ceramic insulator 10. Thus, when the first acute angle θ1 is less than 35 degrees, the breakage was caused in the insulator 10.

When the θ1 exceeds 50 degrees, the component perpendicular to the axis (arrow AR7 in FIG. 3) becomes too large. As a result, the force that would bend the installation thread portion 52 is increased, causing deformation of the installation thread portion 52. Thus, the first acute angle θ1 of over 50 degrees could probably lead to deform the installation thread portion 52, thereby causing thread elongation.

Therefore, the first acute angle θ1 is preferably greater than the second acute angle θ2 and in a range of not less than 35 degrees and not more than 50 degrees. In this way, in the spark plug 100, airtight and dielectric strength properties can be achieved at higher level. Namely, by making the first acute angle θ1 more appropriate, the airtight and dielectric strength properties of the spark plug can be even more improved without causing insulator penetration or thread portion deformation.

A-6: Fourth Evaluation Test

In the fourth evaluation test, seven kinds of samples satisfying the more preferable ranges clarified by the third evaluation test were prepared, and the crimping test was conducted with even more strict conditions than in the third evaluation test. Specifically, in the fourth evaluation test, samples of the spark plug 100 with the nominal diameter of the installation thread portion 52 of 10 mm, the thread portion thickness A=1.38 mm, the shelf thickness B=0.35 mm, the first acute angle θ1=35 degrees, and θ2=30 degrees were used. The seven kinds of samples were prepared by varying the material of the metal shell 50 and the material of the plate packing 8 such that the shelf portion 523 and the plate packing 8 had different hardness E and F. The material of the metal shell 50 was low carbon steel, of which the hardness can be modified by varying the amount of carbon or heat treatment conditions. The material of the plate packing 8 was an alloy with copper or aluminum as a principal component, of which the hardness can be modified by varying the amount of added element or heat treatment conditions.

In the crimping test of the fourth evaluation test, the metal shell 50 of each sample was crimped by using 40 kN of crimping load. Then, the presence or absence of thread elongation in the sample after crimping, and the presence or absence of breakage in the ceramic insulator 10 were evaluated by the same method as in the third evaluation test. The evaluation results are shown in Table 4. In Table 4, "Good" indicates the absence of thread elongation or breakage, while "Poor" indicates the presence of thread elongation or breakage.

Further, in a cross section of each sample taken in a plane including the axis CO, Vickers hardness (Hv) was measured by the Vickers hardness test with measuring load of 1.961 N according to the JIS Z2244 standard. The plate packing 8 was measured at one location corresponding to substantially the central point in the cross section. The shelf portion 523 of the metal shell 50 was measured at three locations in the cross section at substantially equal intervals and 0.1 mm away from the tapered inner face 523*a*. The number of measurements taken in the cross section was five per each kind of sample. Average values of the measurement values were taken to provide hardness E and F of each sample. The evaluation results are shown in Table 4.

TABLE 4

| Sample No. | E | F | E-F | Thread extension | Insulator breakage |
|---|---|---|---|---|---|
| 4-1 | 132 | 122 | 10 | Poor | Good |
| 4-2 | 137 | 122 | 15 | Good | Good |
| 4-3 | 140 | 121 | 19 | Good | Good |
| 4-4 | 152 | 120 | 32 | Good | Good |
| 4-5 | 160 | 120 | 40 | Good | Good |
| 4-6 | 164 | 118 | 46 | Good | Good |
| 4-7 | 169 | 119 | 50 | Good | Poor |

In the test results shown in Table 4, no thread elongation is caused in the samples (4-2) to (4-7) with the difference between the hardness E of the shelf portion 523 and the hardness F of the plate packing 8 (E−F) of not less than 15 Hv, while thread elongation is caused in the sample (4-1) with the difference (E−F) of less than 15 Hv. In the samples (4-1) to (4-6) with the difference (E−F) of not more than 46 Hv, no breakage is caused in the ceramic insulator 10, while breakage is caused in the ceramic insulator 10 in the sample (4-7) with the difference (E−F) exceeding 46 Hv. This is presumably due to the following reasons.

When the difference (E−F) exceeds 46 Hv; namely, when the plate packing 8 is excessively soft with respect to the shelf portion 523, the amount of deformation of the plate packing 8 is excessive, and the deformed plate packing 8 protrudes toward the ceramic insulator 10 (see the dashed line TP in FIG. 3). As a result, the protruding plate packing 8 contacts the ceramic insulator 10, thus causing breakage in the ceramic insulator 10. When the difference (E−F) is less than 15 Hv; namely, when the plate packing 8 is excessively hard with respect to the shelf portion 523, the amount of deformation of the plate packing 8 is insufficient, and excessive load is applied to the tapered inner face 523*a* of the shelf portion 523. As a result, the installation thread portion 52 is deformed, causing thread elongation.

Thus, from the test results of the fourth evaluation test (Table 4), it is more preferable that the difference between hardness E and hardness F (E−F) satisfies 15 Hv≤(E−F)≤46 Hv. In this way, airtight and dielectric strength properties can be achieved at higher level in the spark plug 100. Namely, by making the hardness E of the shelf portion 523 and the hardness F of the plate packing 8 more appropriate, the airtight and dielectric strength properties of the spark plug can be further improved without causing insulator breakage or thread portion deformations.

B. Modification (1) In the above embodiment, the inner side face 523*b* of the shelf portion 523 is parallel with the axis CO. However, the shelf portion 523 may have an increasingly greater inner diameter from the rear end to the front end, as in the inversely tapered inner face 523*c* of the shelf portion 523. In this case, too, the shelf thickness B of the shelf portion 523 is determined by the inner diameter R3 at the front end P2 of the tapered inner face 523*a*. Similarly, while the inner periphery on the rear end with respect to the shelf portion 523 of the installation thread portion 52 is parallel with the axis CO, the inner diameter may be increased from the rear end to the front end. In this case, too, the thread portion thickness A of the installation thread portion 52 or the shelf thickness B of the shelf portion 523 is determined by the inner diameter R2 at the rear end P1 of the tapered inner face 523*a*.

(2) In the cross section of FIG. 2, the tapered inner face 523*a* is linear along its entire length. However, the tapered inner face 523*a* may be curved around the front and rear ends, as in the tapered outer face 15*a*. In this case, the first acute angle θ1 formed by the tapered inner face 523*a* of the shelf portion 523 and the plane TF perpendicular to the axis CO is determined by the linear central portion between the front end curve and the rear end curve.

(3) The improvements in airtight and dielectric strength properties of the spark plug 100 according to the embodiment are considered due to parameters concerning the shelf portion 523 of the metal shell 50 and nearby configuration elements (such as the plate packing 8 and the ceramic insulator 10); namely, due to the thread portion thickness A, the shelf thickness B, the first acute angle θ1, the second acute angle θ2, and the Vickers hardness E and F. Thus, the elements other than these parameters, such as the material of the metal shell 50 and the material of the plate packing 8, may be variously modified. For example, the material of the metal shell 50 may be nickel-plated low carbon steel, or low carbon steel without nickel plating. The material of the plate packing 8 may include copper, aluminum, iron, zinc, or various alloys containing these elements as a principal component.

(4) The foregoing embodiment has been described with reference to an example configuration of the spark plug. However, the embodiment is merely an example and may be variously modified in accordance with the purpose or required performance of the spark plug. For example, instead of the longitudinal discharge type of spark plug that discharges in the axial direction, the invention may be configured, as a lateral discharge type of spark plug that discharges in a direction perpendicular to the axial direction.

While the present invention has been described with reference to the embodiment and the modification, the description of the embodiment is intended to aid an understanding of the present invention and not to limit the present invention. Various modifications and improvements may be made in the present invention without departing from the spirit of the invention and the scope of the claims, and the present invention includes equivalents thereof.

DESCRIPTION OF REFERENCE SIGNS

5 Gasket
6 Ring member
8 Plate packing
9 Talc
10 Ceramic insulator
12 Through-hole
13 Insulator nose portion
15 Step portion
15*a* Tapered outer face
16 Step portion
17 Front end body portion

18 Rear end body portion
19 Flange portion
20 Center electrode
21 Electrode base material
22 Core material
23 Head portion
24 Flange portion
25 Nose portion
29 Electrode tip
30 Ground electrode
31 Base material front end portion
32 Base material proximal end portion
33 Electrode tip
40 Terminal metal fitting
41 Cap installing portion
42 Flange portion
43 Nose portion
50 Metal shell
51 Tool engaging portion
52 Installation thread portion
53 Crimping portion
54 Seating portion
58 Compressive deformation portion
59 Through-hole
60 Electrically conductive seal
70 Resistor element
80 Electrically conductive seal
100 Spark plug
521 Thread ridges
523 Shelf portion
**523*a*** Tapered inner face
**523*b*** Inner side face
**523*c*** Inversely tapered inner face

The invention claimed is:

1. A spark plug comprising:

a tubular insulator having an axial hole extending in a direction of an axis thereof, the tubular insulator having an outer periphery with a tapered outer face where an outer diameter thereof decreases from a rear end to a front end thereof;

a tubular metal shell having a through-hole extending in the axial direction through which the insulator is inserted, the tubular metal shell having a thread portion including an installation thread ridge on an outer periphery of the thread portion and a tapered inner face where an inner diameter thereof decreases from the rear end to the front end on an inner periphery of the thread portion; and a circular packing, which is sandwiched between the tapered outer face of the insulator and the tapered inner face of the metal shell to seal a gap therebetween, wherein:

the thread portion has a nominal diameter of not more than 10 mm; and on at least one cross section including the axis, relationships $(A/B)\geq 3.1$, $B\geq 0.25$, and $(A+B)\leq 2.0$ are satisfied, where A represents a length (mm) of (a difference between an effective diameter of the thread portion and an inner diameter at a rear end of the tapered inner face)/2, and B represents a length (mm) of (a difference between the inner diameter at the rear end of the tapered inner face and an inner diameter at a front end of the tapered inner face)/2.

2. The spark plug according to claim 1, wherein:

the length A satisfies $1.23\leq A\leq 1.54$; and the length B satisfies $0.25\leq B\leq 0.45$.

3. The spark plug according to claim 1, wherein the tapered inner face of the metal shell and a plane perpendicular to the axis form an acute angle of not less than 35 degrees and not more than 50 degrees, and is greater than an acute angle formed by the tapered outer face of the insulator and the plane perpendicular to the axis.

4. The spark plug according to claim 1, wherein a relationship $15\leq(E-F)\leq 46$ is satisfied, where E (Hv) is the Vickers hardness of a portion of the metal shell in which the tapered inner face is formed, and F (Hv) is the Vickers hardness of the packing.

5. The spark plug according to claim 2, wherein the tapered inner face of the metal shell and a plane perpendicular to the axis form an acute angle of not less than 35 degrees and not more than 50 degrees, and is greater than an acute angle formed by the tapered outer face of the insulator and the plane perpendicular to the axis.

6. The spark plug according to claim 2, wherein a relationship $15\leq(E-F)\leq 46$ is satisfied, where E (Hv) is the Vickers hardness of a portion of the metal shell in which the tapered inner face is formed, and F (Hv) is the Vickers hardness of the packing.

7. The spark plug according to claim 3, wherein a relationship $15\leq(E-F)\leq 46$ is satisfied, where E (Hv) is the Vickers hardness of a portion of the metal shell in which the tapered inner face is formed, and F (Hv) is the Vickers hardness of the packing.

8. The spark plug according to claim 5, wherein a relationship $15\leq(E-F)\leq 46$ is satisfied, where E (Hv) is the Vickers hardness of a portion of the metal shell in which the tapered inner face is formed, and F (Hv) is the Vickers hardness of the packing.

* * * * *